United States Patent [19]

Shinomiya et al.

[11] 4,002,249

[45] Jan. 11, 1977

[54] APPARATUS FOR STACKING SHEET MEMBERS

[75] Inventors: Tsutomu Shinomiya; Eiichi Yoshino, both of Iwatsuki, Japan

[73] Assignee: Kabushiki Kaisha Tomoku, Otaru, Japan

[22] Filed: June 18, 1975

[21] Appl. No.: 587,802

[30] Foreign Application Priority Data

Aug. 29, 1974 Japan ..... 49-98379

[52] U.S. Cl. ..... 214/6 H; 214/6 P; 271/200; 271/217

[51] Int. Cl.[2] ..... B65H 29/18; B65H 31/08

[58] Field of Search ..... 271/198, 200, 217, 213, 271/201, 191; 214/6 P, 6 H; 198/35, 139; 93/93 DP

[56] References Cited

UNITED STATES PATENTS

| | | | |
|---|---|---|---|
| 2,477,830 | 8/1949 | Sandberg | 271/201 |
| 2,946,465 | 7/1960 | Raynor | 214/6 P |
| 3,525,444 | 8/1970 | Brockmuller | 271/217 X |
| 3,627,099 | 12/1971 | Shaffer | 214/6 H X |
| 3,866,741 | 2/1975 | Carbon et al. | 198/35 |

*Primary Examiner*—Evon C. Blunk
*Assistant Examiner*—Bruce H. Stoner, Jr.

[57] ABSTRACT

Apparatus for stacking sheet members in a number of piles, having a conveying passage for the sheet members, so constructed that a downstream end portion thereof can be lengthened and shortened, a stop member movable up and down, facing the downstream end portion, and a lifting mechanism which can be elevated and lowered below a space formed between the end portion of the passage and the stop member.

3 Claims, 7 Drawing Figures

A
A
1
2
3
4
5
5a
6
7
20
21
22
23
25
27
27a
29
30
31
32
33
34
37
38
39
40
41
42
43
44
45
46
47
48a
48b
49
50
51
52

APPARATUS FOR STACKING SHEET MEMBERS

This invention relates to an apparatus for stacking in layers a number of sheet members, e.g., made of corrugated cardboard, wood, synthetic resin or the like.

In a case where sheet members are to be automatically stacked in piles or layers, it has been customary to provide a stop member at the end of a conveying passage for the sheet members, spaced therefrom, so that the members successively discharged from the passage come into collision with the stop member and are dropped onto a pallet provided below the space formed between the passage and the stop member, whereby the sheets are stacked in layers or piles on the pallet.

With this conventional stacking arrangement, since the stop member is positioned ahead of the conveying direction of the conveying passage, the pallet must be taken away sidewards after completion of the stacking of the sheets, and the fresh pallet must be supplied from the opposite side. This is a considerable inconvenience because a comparatively wide place is needed for the construction of the conveying passage.

Additionally, it has been customary that, for improving working efficiency, the stacking of sheet members on the pallet is not terminated by forming single piles thereof but is rather performed in several piles. It has therefore been necessary that, after completion of the first pile, the stack is moved on the pallet by a distance nearly equal to the length of the sheet members, and then there is formed a subsequent pile. Accordingly there is a danger that the stack or pile falls over during the movement of the pallet.

This invention has for its object to provide a stacking apparatus free from dangers and inconveniences as mentioned above, and it is characterized in that a conveying passage for sheet members is so constructed that a downstream end portion thereof can be lengthened and shortened, a stop member being provided which can be moved up and down, facing a downstream end portion of the passage, with lifting means which can be elevated and lowered below a space formed between the end portion of the passage and the stop member.

Other objects, inventive features and advantages thereof will become clear from the following detailed description of the invention, when read with reference to the accompanying drawings, wherein.

Figure 1:
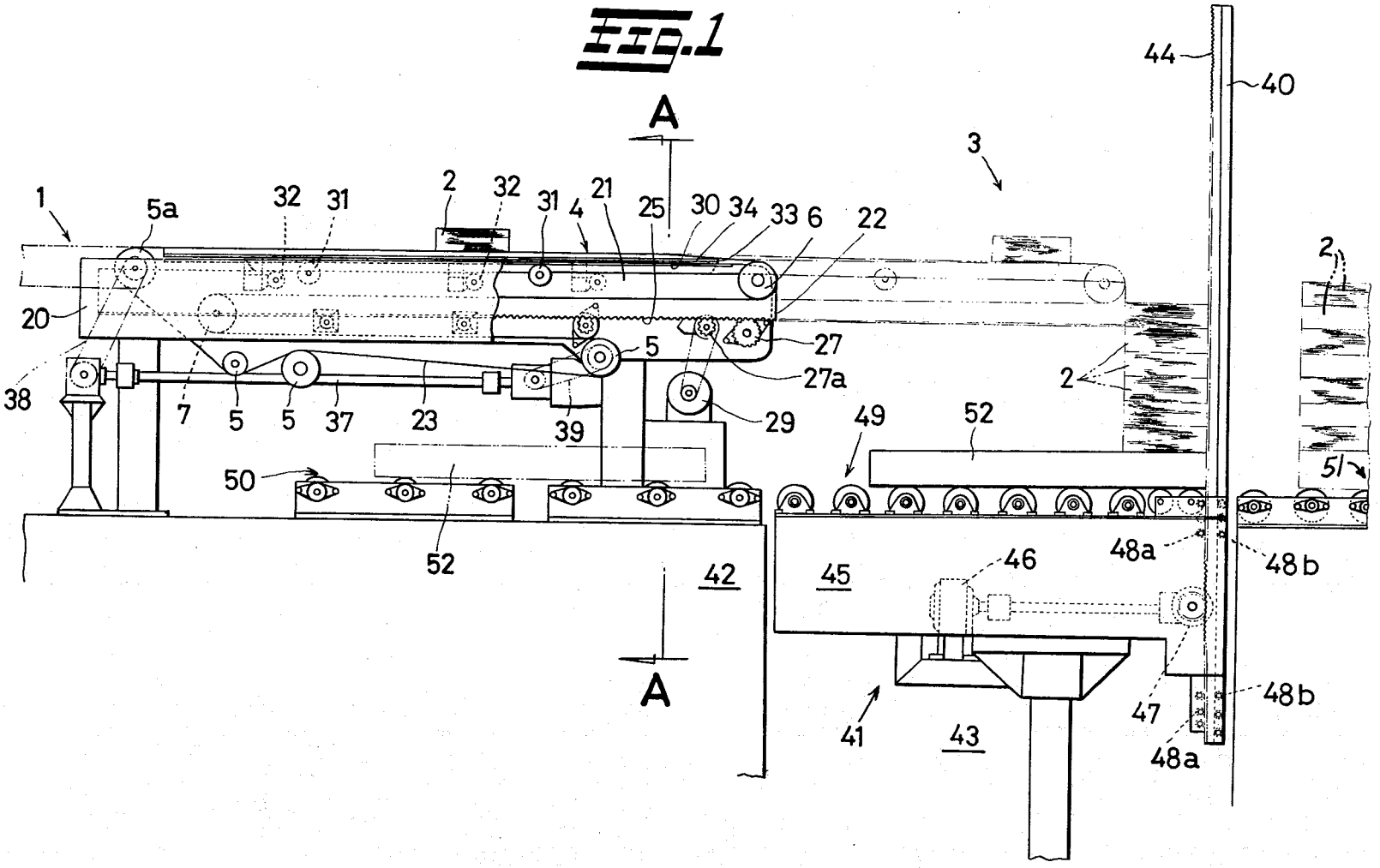
FIG. 1 is a side-elevational view of a preferred exemplary embodiment of the apparatus according to this invention.

FIGS. 3*a* to 3*d* are schematic partial views showing consecutive operating conditions of the apparatus.

In the drawings, a conveying passage 1 is shown, comprising a number of endless belts arrranged parallel and side by side, to carry and feed sheet members 2, for example, corrugated cardboard or the like. A number of such sheet members 2 may be obtained from a continuous member wound into a roll, by cutting the same into pieces of proper length, which are conveyed along the passage 1 towards stacking means 3.

A downstream end portion 4 of the conveying passage 1 is so constructed that a number of narrow endless belts 23 (see FIG. 2) are applied so as to extend over a number of pulleys 5 provided between a pair of stationary lateral outer machine frames 20. Two pulleys 6, 7 are provided (see again FIG. 1) between movable lateral inner machine frames 22 arranged to move into and out from respective elongated larger, box-shaped machine frames 21 that are fixedly provided on the inner sides of the respective frames 20.

Figure 2:
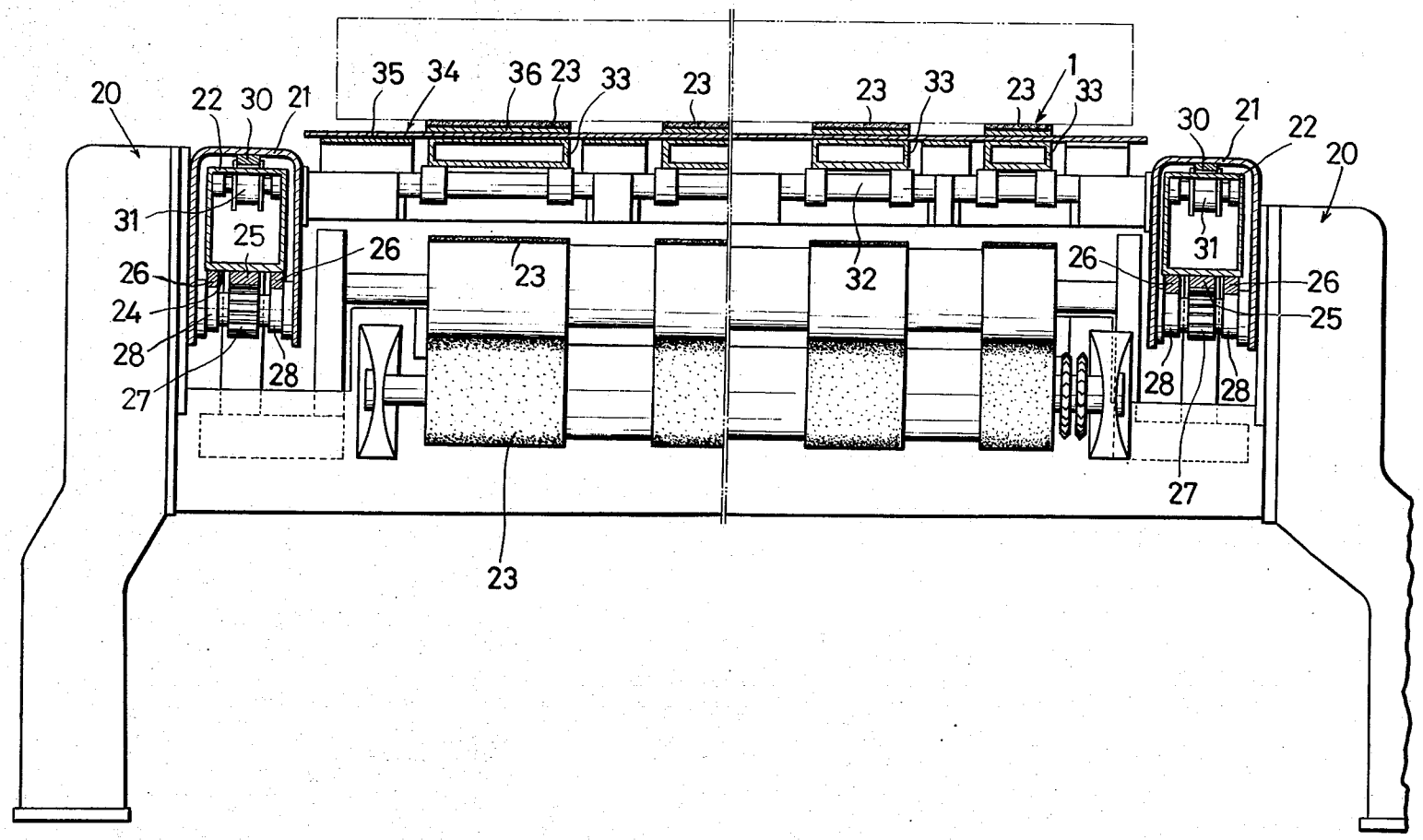
FIG. 2 is a sectional view taken along line II — II in FIG. 1.

As shown in FIG. 2, the movable frames 22 are carried by racks 25 and rails 26 which are provided on lower surfaces 24 thereof, on a number of aligned pinion wheels 27 and rollers 28, these being integral with a corresponding pinion wheel 27. These rollers 28 and wheels 27 are disposed within the inner space of each box-shaped machine frame 21 so that if the wheel 27*a* is driven in either direction by an electric motor 29, the movable frames 22 along with the racks 25 are moved in the longitudinal direction so as to project out from or retract into the respective frames 21.

Numeral 30 denotes rails provided at the upper portions in the interiors of the frames 21, and the rails are arranged to be in rolling contact with rollers 31 provided at the upper portions of the frames 22 so that the latter slide smoothly.

If the frames 22 are extended as shown in FIG. 1 by dot-dashed lines, the distance between the innermost pulley 5*a* of the frame 21 and the pulley 6 of the frame 22 are elongated, and thereby the belts 23 are somewhat pulled down at their extended portions due to the weight of the sheet members 2. Accordingly the frames 21 are provided with rollers 32 therebetween, and a number of flat box-shaped members 33, preferably made of stainless steel sheet or the like, are arranged to move along together with the protruding and retracting movement of the frames 22, whereby the pull on the belts 23 or their hanging down can be prevented.

Numeral 34 denotes a plate which enables the belts 23 to slide thereon smoothly, and it serves to prevent the belts from hanging. The same is so formed that wooden plates 36, each being equal in width to a belt 23, are put integrally on the upper surface of an iron sheet 35. Numeral 37 denotes a rotating shaft driven by a proper power source, and it is so arranged that the rotation thereof is transmitted to the pulleys 5*a*, 5*a* through chains 38, 39.

Numeral 40 denotes a plate-formed stop member which is flat at the front surface and is movable to appear and disappear in upward and downward directions, and faces the end of the downstream end portion 4 of the conveying passage 1. A lifting member 41 can be elevated and lowered by an oil-pressure cylinder or the like through a recessed portion 43 of a base 42, and is positioned within a space formed between the end portion 4 and the stop member 40.

The latter is so arranged that it can be moved to appear and disappear toward the top and the bottom while passing between guide rollers 48*a*, 48*b* when a pair of racks 44, provided on both sides of the front surface portion of the member 40, are moved by pinion wheels 47, driven by an electric motor 46 provided below a table 45 of the lifting member 41.

Roller groups 49, 50, 51, which properly can be driven by an electric motor, are provided on the table 45 and the base portions 42 in front and rear of the table 45, so that when the roller groups are simultaneously rotated, a pallet 52 can be moved out in the conveying direction of the passage 1, at the completion of the stacking of the sheet members 2 on the table 45. Thereafter a fresh pallet 52 is supplied onto the table 45 from the roller group 50 that is provided below the downstream end portion 4.

Next, the operation of the inventive apparatus will be explained as follows: As shown in FIG. 3*a*, the motor 46 is so driven that the stop member 40 protrudes to an elevated position that is somewhat higher than the end portion 4 of the passage 1, and the motor 29 is so rotated that the frames 22 are moved to extend to a position where the space between the end portion 4 and the member 40 becomes nearly equal to the length of the sheet members 2. Then, the lifting member 41 is elevated so that the pallet 52, placed on the upper surface thereof, is positioned somewhat below the movable frames 22 of the downstream end portion 4.

With such a setting, the sheet members 2, supplied one after the other on the conveying passage 1, come consecutively to abut against the stop member 40 and are dropped into the space between the end portion 4 and the member 40, so that these sheets 2 are sequentially stacked in layers, forming a pile, on the pallet 52.

During this operation, the member 41 is gradually lowered in accordance with the number of the sheets stacked, and it is so controlled that the dropped position of the sheet members 2 is always constant. If the height of the stack of sheets 2 on pallet 52 reaches a predetermined height, as shown in FIG. 3*b*, the member 41 is again elevated, to a position somewhat below the frames 22, and at the same time these frames are retracted by a length nearly equal to the length of the sheet members 2, whereby these are conveyed, one after the other, on the passage 1, and are stacked at the new position on the pallet 52, adjoining the previously formed sheet stack or pile. In this case, each sheet 2 is dropped after the same hits the previous stack, and thus a second, and later a subsequent stack or pile is formed.

Figure 3C:
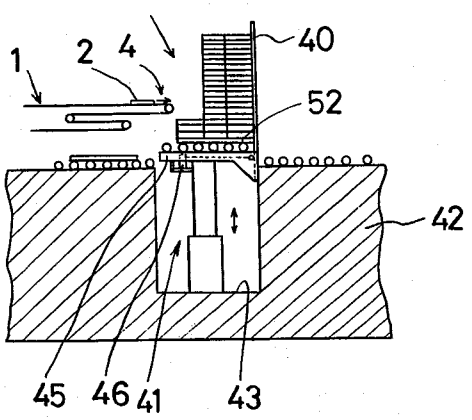
Figure 3D:
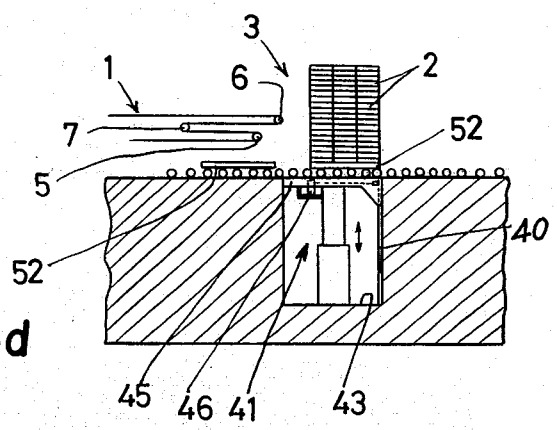
Figure 3A:
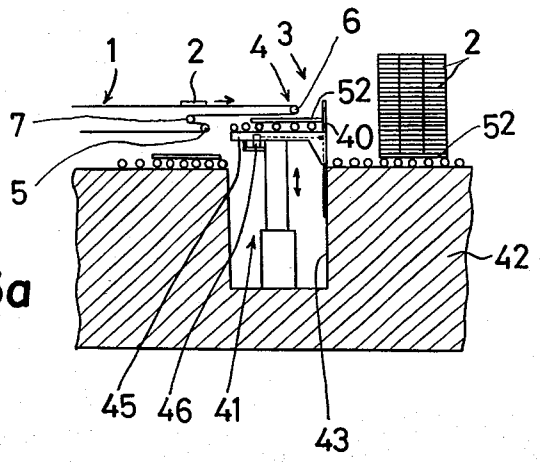
Figure 3B:
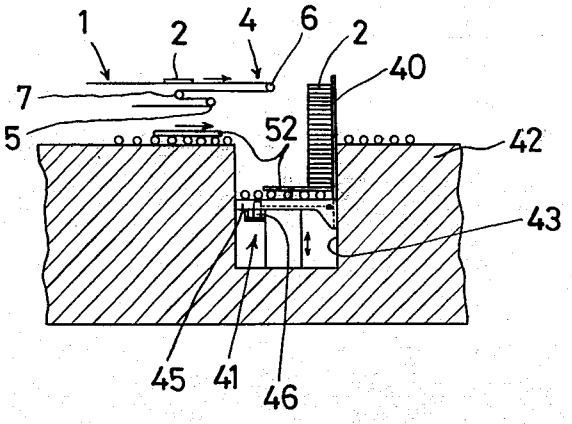

The above operation is repeated as shown in FIG. 3*c*, and when the pallet 52 is fully loaded with the sheet members 2, as shown in FIG. 3*d*, the table 45 is brought to a position nearly level with the base portions 42, and at about the same time, the stop member 40 is lowered to a position where the upper end thereof sinks below the base 42. Now the roller groups 49 to 51 are so rotated so that the pallet 52, after the stacking of the sheets 2, is moved in the conveying direction of the passage 1.

At the same time with the discharging of the pallet 52, a fresh pallet 52 is supplied on the roller group 50 onto the lifting member 41. Then, at the downstream end portion 4 of the conveying passage 1, the stop member 40 and the lifting member 41 repeat the foregoing operations for stacking the sheets thereon.

Thus, according to this invention, the downstream end portion of the conveying passage can be lengthened and shortened, and the stop means, which can be moved up and down, are provided so as to face the downstream end portion, and the lifting means, which can also be elevated and lowered, is provided between the downstream end portion and the stop means. Thus the sheet members can successively be stacked on the lifting means, and when the formation of a single lot or pile is completed, the next stack lot can be formed by shortening the downstream end portion and elevating the lifting means, without displacing the previously formed stack. Thus the stack of sheet members can be securely prevented from collapsing, and additionally the stacked sheets can be taken away in the conveying direction by making the stop member to retract, so that the stacking apparatus can be installed even in a narrow place.

It will of course be understood by those skilled in the art that various modifications and changes can be made in the described apparatus, which will be self-evident and easily understood by the experts, without departing from the spirit and scope of the present invention.

What we claim is:

1. Apparatus for stacking sheet members in a plurality of piles, said apparatus comprising: substantially horizontal conveyor means for conveying a stack of sheets thereon, said conveyor means including a downstream end portion, lifting means disposed adjacent said downstream end portion of the conveyor means for receiving sheets thereon, drive means for extending and retracting said conveyor means with respect to said lifting means, means for raising and lowering said lifting means, a stop member comprising a vertically movable plate mounted on said lifting means for movement between a raised and a lowered position, said plate being downstream of said downstream end portion of the conveyor means with the latter in extended position, means for raising and lowering said stop member relative to said lifting means, said stop member in said raised position being above the level of the conveyor means so that stacks of sheets successively deposited onto said lifting means form a first pile of sheets abutting against said stop member, said lifting means having a support surface with a horizontal extent sufficient to accommodate a plurality of piles of sheets thereon, said downstream end portion being retracted by the drive means, after formation of said first pile of sheets on said lifting means, a distance equal to the width of the pile such that a second pile of sheets can be formed adjacent said first pile, and support means on said lifting means for displaceable support thereon of said piles of sheet members, said support means comprising a plurality of rollers for support of a pallet on which the sheets can be deposited, said plate in lowered position being disposed below said rollers to permit travel of the pallet on said rollers.

2. Apparatus as claimed in claim 1 comprising a pair of stationary outer frame members, said downstream end portion of the conveyor means including a plurality of narrow endless belts displaceably mounted between said outer frame members.

3. Apparatus as claimed in claim 2, further comprising elongated box-shaped frames fixed inside said outer frame members, said downstream end portion of the conveyor means including a pair of movable inner frame members movably mounted in said box-shaped frames.

* * * * *